US007880593B2

(12) United States Patent
Baldwin et al.

(10) Patent No.: US 7,880,593 B2
(45) Date of Patent: Feb. 1, 2011

(54) AUDIBLE SIGNALING DEVICE

(75) Inventors: Christopher M. Baldwin, Avon, IN (US); Daniel O'Brien, Mooresville, IN (US); Mark T. Monnett, Cloverdale, IN (US)

(73) Assignee: Mallory Sonalert Products, Inc., Indianapolis, IN (US)

( * ) Notice: Subject to any disclaimer, the term of this patent is extended or adjusted under 35 U.S.C. 154(b) by 173 days.

(21) Appl. No.: 12/012,695

(22) Filed: Feb. 5, 2008

(65) Prior Publication Data

US 2009/0195367 A1 Aug. 6, 2009

(51) Int. Cl.
*G10K 9/20* (2006.01)

(52) U.S. Cl. ..... 340/388.4; 340/388.1; 340/384.1

(58) Field of Classification Search ..... 340/388.1, 340/388.4, 384.6, 384.1
See application file for complete search history.

(56) References Cited

U.S. PATENT DOCUMENTS

| | | | | | |
|---|---|---|---|---|---|
| 4,796,009 | A * | 1/1989 | Biersach | ..... | 340/388.4 |
| 4,871,984 | A * | 10/1989 | Laton et al. | ..... | 331/107 A |
| 5,414,406 | A * | 5/1995 | Baxter | ..... | 340/388.1 |
| 5,872,506 | A * | 2/1999 | O'Brien et al. | ..... | 340/384.6 |
| 6,512,450 | B1 * | 1/2003 | Burnett et al. | ..... | 340/384.1 |
| 6,617,967 | B2 * | 9/2003 | Baldwin et al. | ..... | 340/384.6 |
| 6,756,883 | B2 * | 6/2004 | Burnett et al. | ..... | 340/384.1 |
| 2002/0121966 | A1 * | 9/2002 | Woodard et al. | ..... | 340/384.6 |
| 2006/0139153 | A1 * | 6/2006 | Adelman | ..... | 340/388.4 |

* cited by examiner

*Primary Examiner*—Travis R Hunnings
(74) *Attorney, Agent, or Firm*—Niro, Haller & Niro

(57) ABSTRACT

The invention is an improved audible signaling device with a speaker, a sound chamber, and associated circuitry. The device creates a loud, audible fundamental frequency, and harmonic frequencies that are relatively equal in amplitude to the amplitude of the fundamental frequency.

6 Claims, 2 Drawing Sheets

AUDIBLE SIGNALING DEVICE

BACKGROUND OF THE INVENTION

The invention relates to an improved audible signaling device. In environments where multiple warning devices are present, or where there is significant background noise, there is a need for unique audible warning sounds. One way to make a unique warning sound is to include multiple harmonic frequency components in addition to the fundamental frequency of the warning sound. See, for example, IEC 60601-1-8, "Medical Electrical Equipment—Part 1-8: General Requirements for Safety—Collateral Standard" General Requirements, Tests and Guidance for Alarm Systems in Medical Electrical Equipment and Medical Electrical Systems," 1st edition, 2003, published by the International Electrotechnical Commission, 3 rue de Varembe, P.O. Box 131, CH-1211, Geneva 20, Switzerland. One advantage from embedding multiple frequencies in an audible sound is that it is easier for a person to locate the origin of the sound. If the background noise masks one or more of the frequencies that make up the sound, the other unmasked sound frequencies can still be heard.

There is also a need for low frequency audible warning sounds because the lower frequency is an alternative to commonly used warning sound frequencies, and because the ability to hear higher frequency sounds generally decreases as a person ages. Currently available technology used to produce a loud, low frequency warning sound with multiple relatively equal frequency components requires the use of a sophisticated controller, expensive power electronics to amplify the electrical drive signal, and a large wattage speaker.

This new signaling device enables the generation of a loud, low frequency warning sound with relatively equal multiple frequency components without necessarily the need for a sophisticated controller, large power electronics, or a large wattage speaker.

SUMMARY OF THE INVENTION

A speaker mounted in a specially designed sound chamber generates a loud, audible sound that has a fundamental sound frequency less than 1 kHz, and also generates multiple harmonic frequencies. The harmonic frequencies are relatively equal in amplitude to the amplitude of the fundamental frequency component in the sound. The sound chamber amplifies the fundamental frequency sound while keeping the multiple harmonic frequency components intact and relatively equal in amplitude to the fundamental frequency sound component.

Where alternative meanings are possible, the broadest meaning is intended. All words used in the claims set forth below are used in the normal, customary usage of grammar and the English language as understood by a person of ordinary skill in the art.

DETAILED DESCRIPTION OF THE INVENTION

Set forth below is a description of what is currently believed to be the preferred embodiment or best example of the invention claimed. Future and present alternative and modifications to this preferred embodiment are contemplated. Any alternatives or modifications that make insubstantial changes in function, in purpose, in structure or in result are intended to be covered by the claims of this patent.

The speaker-housing assembly is designed to acoustically produce a sound with a fundamental frequency less than 1 kHz, and to produce multiple harmonic frequencies that are relatively equal in amplitude to the fundamental frequency when an electrical drive signal applied to the speaker-housing assembly consists of only a single frequency component. The speaker is chosen for its ability to acoustically produce a sound with multiple harmonic frequency components of relatively equal value to the fundamental frequency component as well as having a frequency capability less than 1 kHz. The speaker is mounted in sound chamber whose height, diameter, and front hole opening are designed to amplify the sound while enabling a fundamental sound frequency less than 1 kHz without significantly affecting the amplitude and number of the harmonic frequency components. Because the sound chamber acoustically amplifies the sound generated by the speaker, the physical size of the speaker is reduced. The power required by the speaker is also reduced.

Figure 1A:
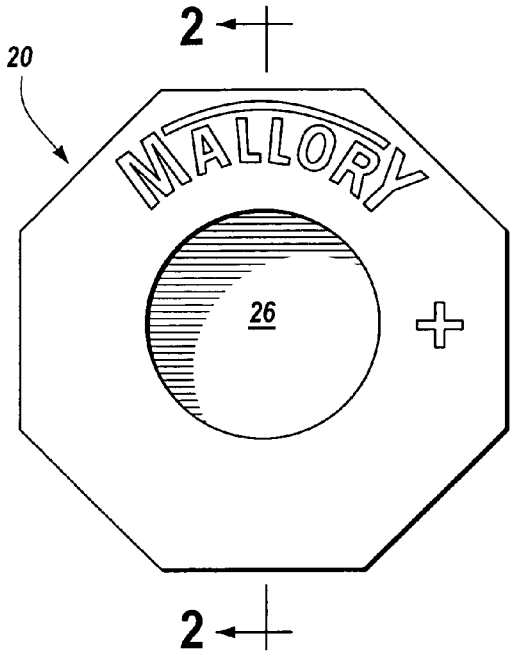
FIGS. 1A and 1B are top and bottom views of one embodiment of a signaling device.
Figure 1B:
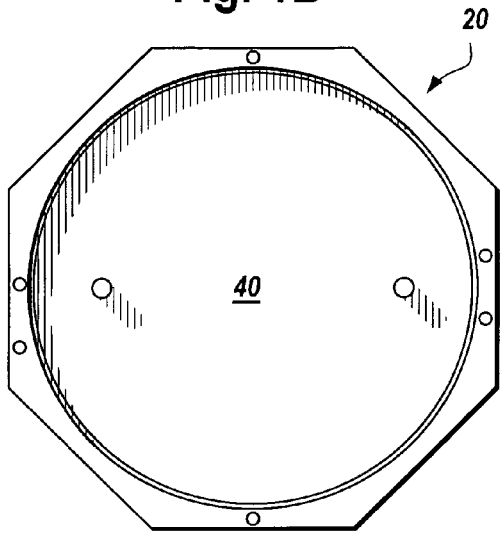
Figure 2:
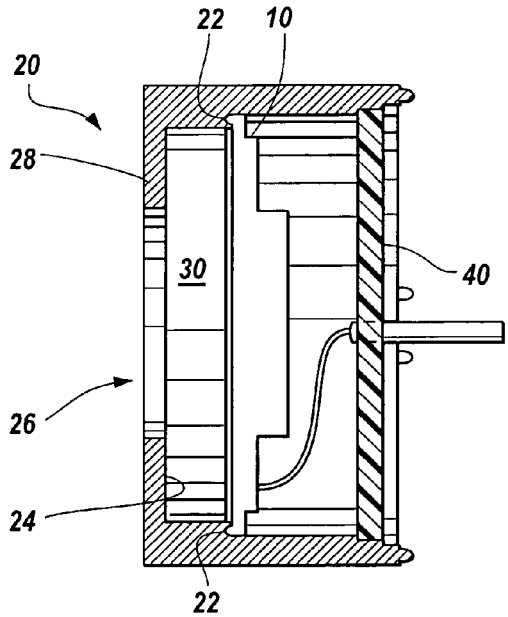
FIG. 2 is a sectional view taken through A-A of FIG. 1A of the signaling device.

Refer to FIGS. 1A, 1B and 2 depicting a signaling device. A speaker 10 is mounted within a housing 20. The speaker 10 is an 8 ohm, 0.25 watt speaker. Other suitable speakers known to those of skill in the art may be substituted. The rim of speaker 10 is attached to a ledge 22 extending around the interior circumference of housing 20. The method of attachment is not significant so long as speaker 10 remains firmly attached to housing 20. In this embodiment, ledge 22 is separated from a front inside surface 24 of housing 20. The distance between inside surface 24 and ledge 22 is 0.125 inches, with a tolerance of plus or minus 0.005 inches.

Surface 24 has an opening 26 that is 0.437 inches in diameter, with a tolerance of plus or minus 0.005 inches. Because opening 26 is not the same diameter as housing 20, a lip 28 is formed around opening 24. Speaker 10, housing 20, and lip 28 form a chamber 30 between speaker 22 and opening 26. Chamber 30 amplifies the fundamental frequency emitted by speaker 10. Thus, the multiple harmonic frequencies are approximately equal in amplitude to the fundamental frequency produced by speaker 10. Because of opening 26, a person in the vicinity of the signaling device is able to hear a blended sound, consisting of multiple frequencies.

An electrical circuit generates the single frequency electrical drive signal that is applied to the speaker-housing assembly. It produces a loud, audible sound with a fundamental frequency less than 1 kHz and multiple harmonic frequencies that are relatively equal in amplitude to the fundamental frequency component. The circuit is on a printed circuit board 40, which is mounted to the rear of housing 20. The circuit on board 40 is depicted in FIG. 3.

The electrical drive signal can be generated externally by the user, or by internal circuitry that can be included with the speaker-housing assembly. The electrical drive signal applied to the speaker-housing preferably consists of one frequency or alternatively multiple frequencies.

A simple oscillation circuit that generates an electrical drive signal with one frequency component or alternately multiple frequency components will suffice in creating an output signal. The electrical output signal of the oscillation circuit may need to be amplified before being directed to the speaker-housing assembly, but because the speaker-housing assembly already acoustically amplifies the sound, any amplification circuitry is significantly lower in cost and smaller in size than would otherwise be needed. The base circuit can be made to generate only a single frequency or it can generate the harmonics as well. The circuit shown in FIG. 2 or FIG. 3 of U.S. Pat. No. 5,990,784 is another suitable circuit.

Figure 3:
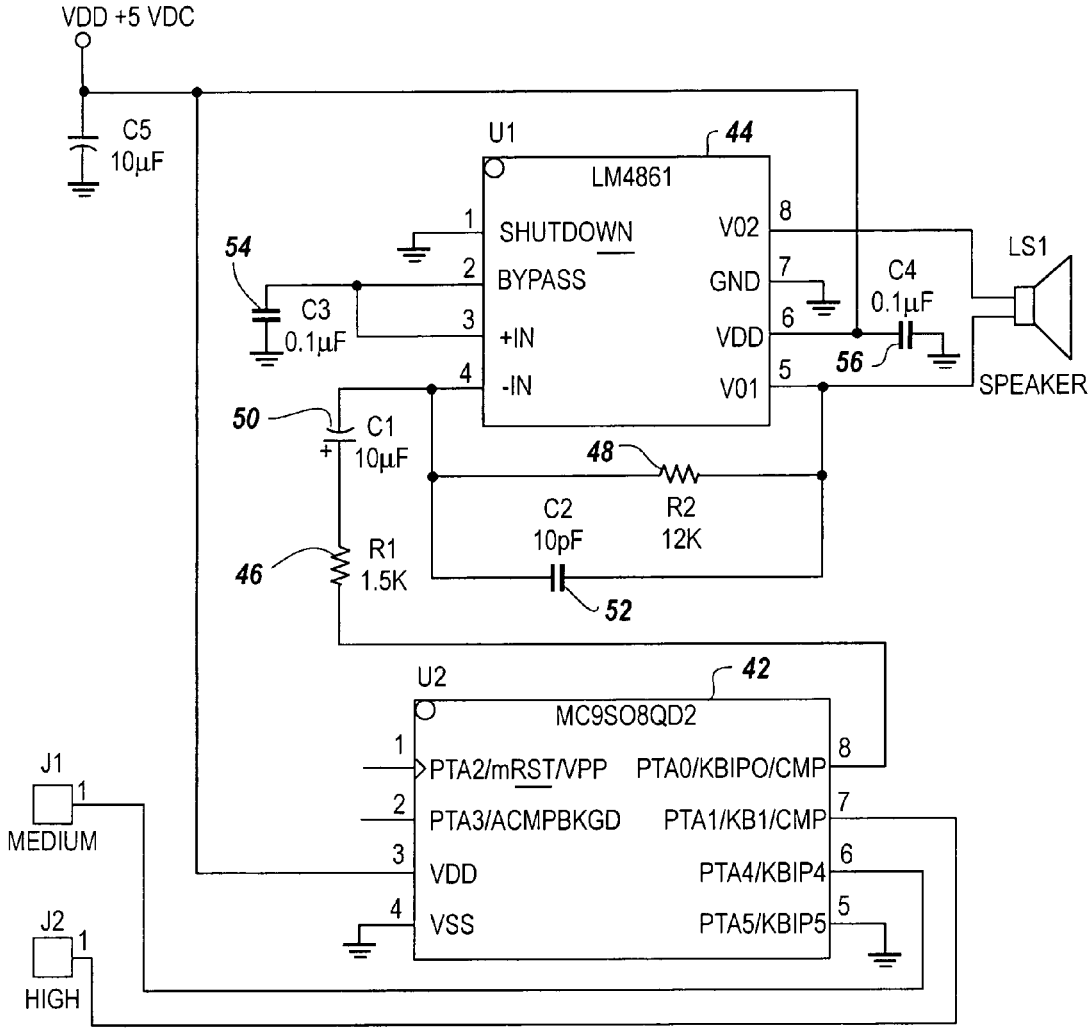
FIG. 3 depicts a typical circuit used in the embodiment of FIGS. 1 and 2 for the signaling device.

The circuit in FIG. 3 shows a diagram of the preferred method of driving the invention, but it will be apparent to one of skill in the art that other circuits may be used. A microcontroller is programmed with the desired sound output frequency and pattern. A Freescale microcontroller, part number MC9S08QD2 may be used. Upon applying power, microcontroller 42 sends a signal to an audio amplifier 44. National Semiconductor part number LM4861 may be used for amplifier 44. A combination of resistors 46 and 48 and capacitors 50 and 52 control the gain of the signal be sent to the speaker. Capacitors 54 and 56 are bypass capacitors. Resistor 46 and capacitor 50 are acting as a high-pass filter. A controller provides additional controllability to the electrical drive signal such as ability to change the electrical drive signal's amplitude or frequency, or by intermittently turning the electrical drive signal on and off. The controller can accomplish this task independently based on its internal programming, or it can take input from an external user or sensor to decide how to adjust the electrical drive signal characteristics. The electrical drive signal from the controller may need to be amplified before being directed to the speaker-housing assembly, but because the speaker-housing assembly already acoustically amplifies the sound, any amplification circuitry will be significantly less in cost and size than would be needed otherwise.

Likewise, it will be appreciated by those skilled in the art that various changes, additions, omissions, and modifications can be made to the illustrated embodiments without departing from the spirit of the present invention. All such modifications and changes are intended to be covered by the claims.

We claim:

1. A signaling device, comprising:

A housing;

A single speaker mounted in the housing that can accept the output of an external electrical circuit to generate a sound having a fundamental frequency no greater than 1000 Hz, with multiple harmonic frequencies;

A sound chamber in the housing for receiving the output of the speaker, and having an opening in the wall away from the speaker, whereby the multiple harmonic frequencies are amplified to an amplitude relatively equal to the amplitude of the fundamental frequency where the diameter of the chamber is does not exceed one-quarter of the wavelength of the fundamental frequency.

2. The device in claim 1 which includes:

An electrical circuit internal to the device.

3. The device in claim 2,

An electrical circuit that generates a single drive frequency.

4. The device in claim 2,

An electrical circuit that generates multiple drive frequencies.

5. The device of claim 4, wherein the multiple drive frequencies include at least one frequency between 300 and 1000 Hz.

6. The device of claim 2, 3 or 4 where the electrical circuit is a solid-state circuit.

* * * * *